United States Patent [19]

Nickaloff

[11] 4,121,514

[45] Oct. 24, 1978

[54] MACHINE FOR COLLECTING, SHREDDING AND COMPACTING CANS

[76] Inventor: Raymond M. Nickaloff, 20004 Stanton Ave., Castro Valley, Calif. 94546

[21] Appl. No.: 663,721

[22] Filed: Mar. 4, 1976

[51] Int. Cl.[2] ..... B30B 15/08; B30B 15/32

[52] U.S. Cl. ..... 100/91; 100/97; 100/100; 100/215; 100/DIG. 2; 15/340

[58] Field of Search ..... 100/97, 100, 215, 90, 100/91, 39, 95, 96, DIG. 2; 241/99, 68, 101.7; 15/340, 415

[56] References Cited

U.S. PATENT DOCUMENTS

| | | | |
|---|---|---|---|
| 1,314,437 | 8/1919 | Silverthorne | 100/90 |
| 2,288,115 | 6/1942 | Soldanels | 15/415 X |
| 3,025,785 | 3/1962 | Deems | 100/90 |
| 3,192,853 | 7/1965 | O'Connor | 100/90 X |
| 3,589,276 | 6/1971 | Swallert | 100/90 |
| 3,636,864 | 1/1972 | Loscialo | 100/91 |
| 3,665,545 | 5/1972 | Beekman | 15/340 X |
| 3,968,938 | 7/1976 | Ruhl | 241/101.7 |

*Primary Examiner*—Billy J. Wilhite
*Attorney, Agent, or Firm*—Julian Caplan

[57] ABSTRACT

Machine to draw metal (especially aluminum) cans by suction into a housing by a vacuum fan. A hose may be used to pick up cans from the ground or cans may be fed manually into the intake of the housing. The intake is at the top of the housing and in registry therewith is a vertical cylinder of expanded metal or machined from high-impact plastic, which directs the cans down through a conical hopper of high-impact plastic. Small foreign particles pass through the vertical cylinder and hopper and drop to the bottom of the housing. These particles may be collected from the housing from time to time. Dust and very small particles are drawn through the vacuum fan and collected in a filter bag. Large particles such as cans are directed from the hopper to a chute where they are shredded by revolving blades and pass into a compactor housing where they are compressed for salvage.

4 Claims, 3 Drawing Figures

MACHINE FOR COLLECTING, SHREDDING AND COMPACTING CANS

This invention relates to a new machine for collecting, shredding and compacting metal cans, especially aluminum cans. The littering of the landscape by discarded metal cans, especially beverage cans, is a present day important ecological problem. Aluminum cans are not biodegradable and hence are a particularly serious problem. On the other hand, the salvage value of aluminum cans is high as compared with steel cans and the salvage value is greater if the aluminum cans are shredded and compressed. It takes only 5% (five percent) the energy to make a new aluminum can from reclaimed, recycled, aluminum as it does to make the same can from ore, and ore is expensive compared with salvage metal. Thus, a two-way cost savings results: (a) energy savings; (b) material savings. The present invention provides a means for collecting cans which have been discarded and for enhancing their salvage value.

At the present time, discarded cans are frequently deposited in trash cans and then dumped into land-fill dumps. Considerable trash and dump space is devoted to this purpose, space which is saved in accordance with the present invention. Large quantities of cans are deposited in homeowners' trash cans. The elimination of such deposit cuts homeowners' garbage bills and makes available more space for biodegradable items.

The present invention has particular value in cleaning out metal cans and other objects of similar nature from locations where they tend to collect in large numbers. Although there are many others, typical installations are in athletic stadia, the edges of fields where agricultural workers are employed, parking lots, certain roadsides, the trash collection areas of apartment houses, etc. Use of the machine in accordance with the present invention either mounted on a vehicle where it is possible to move the machine to locations where the trash tends to collect or stationarily mounted where consumers can deposit the cans from time to time is particularly advantageous.

Another feature of the invention is the provision of means in the machine to separate the metal from dust and other debris. The dust is filtered in a filter bag. The small parts drop from the mass of metal through grating and the metal, primarily cans, is handled separately from the other materials. It is desirable to handle the aluminum cans separate from other metal containers and for such purpose magnets may be mounted in the collecting head or at other locations in the machine to attract the steel containers and separate them from the aluminum. The present invention is particularly suitable for this purpose.

In order to enhance the salvage value of aluminum cans, it is necessary that they be compacted. Purchasers of the scrap cans prefer that the cans be shredded rather than merely being collapsed because further processing is facilitated. In accordance with the present invention, the cans are not only shredded but also are compacted to considerably reduce bulk.

By salvaging some or all of the metal collected by the machine, the cost of the machine is paid off and the labor required to operate it is compensated.

Steel (i.e. "tin") cans and glass containers may be handled in accordance with the present invention although it is desirable to eliminate the step of shredding such material by removing the shredder blades. Otherwise, the blades may be damaged because of the hardness of the steel or glass. Wood particles, such as branches, may be collected by use of the machine, and fed manually, shredded and shredded particles compressed. Some of the items mentioned herein may best be deposited directly in the housing rather than in the collector nozzle.

Accordingly, the present invention provides a versatile machine which is capable of handling a variety of different types of scrap and delivering the same in an economically useful form while at the same time cleaning the landscape of unsightly debris.

Other objects of the present invention will become apparent upon reading the following specification and referring to the accompanying drawings in which similar characters of reference represent corresponding parts in each of the several views.

Figure 2:
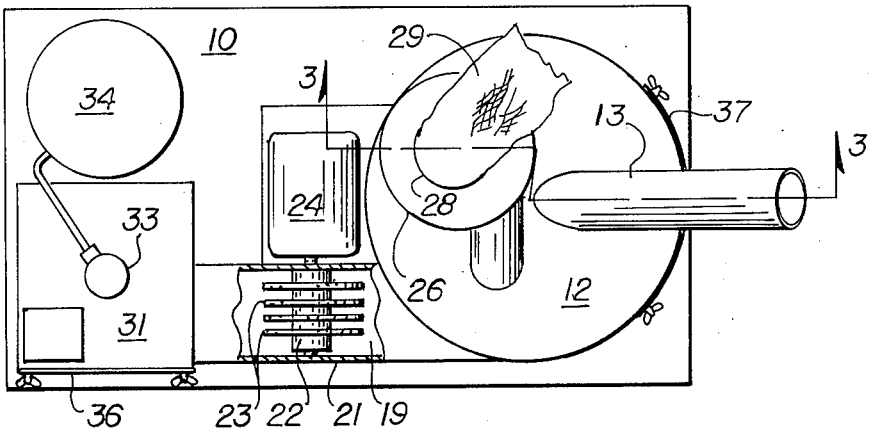
FIG. 2 is a top plan view, also partly broken away to reveal internal construction, of a portion of the structure of FIG. 1.
Figure 3:
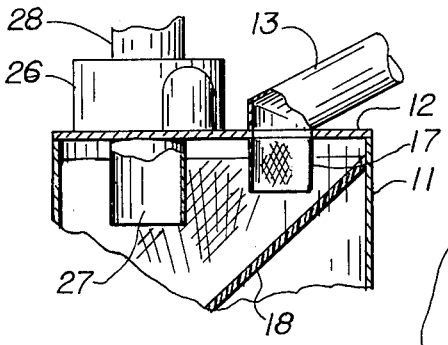
FIG. 3 is a sectional view taken substantially along the line 3—3 of FIG. 2.

The machine hereinafter described is preferably mounted on a horizontal base 10 which may in turn be mounted on a vehicle (not shown) if the machine is to be transported into locations where cans tend to collect. If vehicle mounted, the motor which drives the parts hereinafter described may be energized either from the electrical system of the vehicle or a generator may be mounted on the vehicle; or alternatively, power take-off from the mechanical drive of the vehicle may be connected by means (not shown) to drive the components of the machine, eliminating the motors.

Mounted vertically on base 10 is a housing 11 which is here shown as generally cylindrical in shape. A flat top 12 closes off the top of housing 11 and a downward-inward slanted intake duct 13 extends through the top 12. The outer end of duct 13 may be attached to a elongated flexible hose 14 which is large enough to handle cans and other debris being collected. Optionally, at the outer end of hose 14 is a nozzle 16 shaped to pick up the debris. Although not shown, it will be understood that magnets 15 may be positioned in nozzle 16 to stop passage of magnetizeable material. This is particularly desirable when the machine is used to pick up a pile of cans which are mixed aluminum and steel. By separating out the steel cans and separately handling them, only the aluminum cans can be compacted and hence the necessity of segregating the scrap is eliminated.

Extending downward inside top 12 and in registry with intake duct 13 is a short cylindrical section 17 of expanded metal. The lower end of cylinder 17 discharges into a downwardly-sidewardly slanted conical hopper 18 also preferably formed of expanded metal. The openings in the members 17 and 18 is such that small particles of metal, stone and the like drop to the bottom of hopper 18 and are thus separated from the metal can. The hopper 18 discharges into a downward slanted preferably metal or metal-lined plastic chute 19 which extends out the side of the housing 11 into a shredder housing 21. Rotatable within shredder 21 is a rotor 22 formed of a plurality of large tooth saw blades 23 mounted on the horizontal shaft of motor 24. The gap between the blades 23 and the bottom of chute 19 is sufficiently large so that the metal cans are shredded as they pass under the shredder rotor 22.

Mounted on the top 12 is a vacuum fan 26. The intake of fan 26 employs a solid sheet metal cylinder 27 which directs dust and other very fine particles up into the fan 26 and out duct 28 which handles the discharge of fan 26. A suitable motor (not shown) mounted within the fan housing 26 drives the fan. Where considerable amounts of dust are being drawn into the machine, a dust filter bag 29 may be attached to the outlet of duct 28. Thus the very fine particles drawn in through intake 13 are discharged through duct 28 and may be collected in bag 29.

Figure 1:
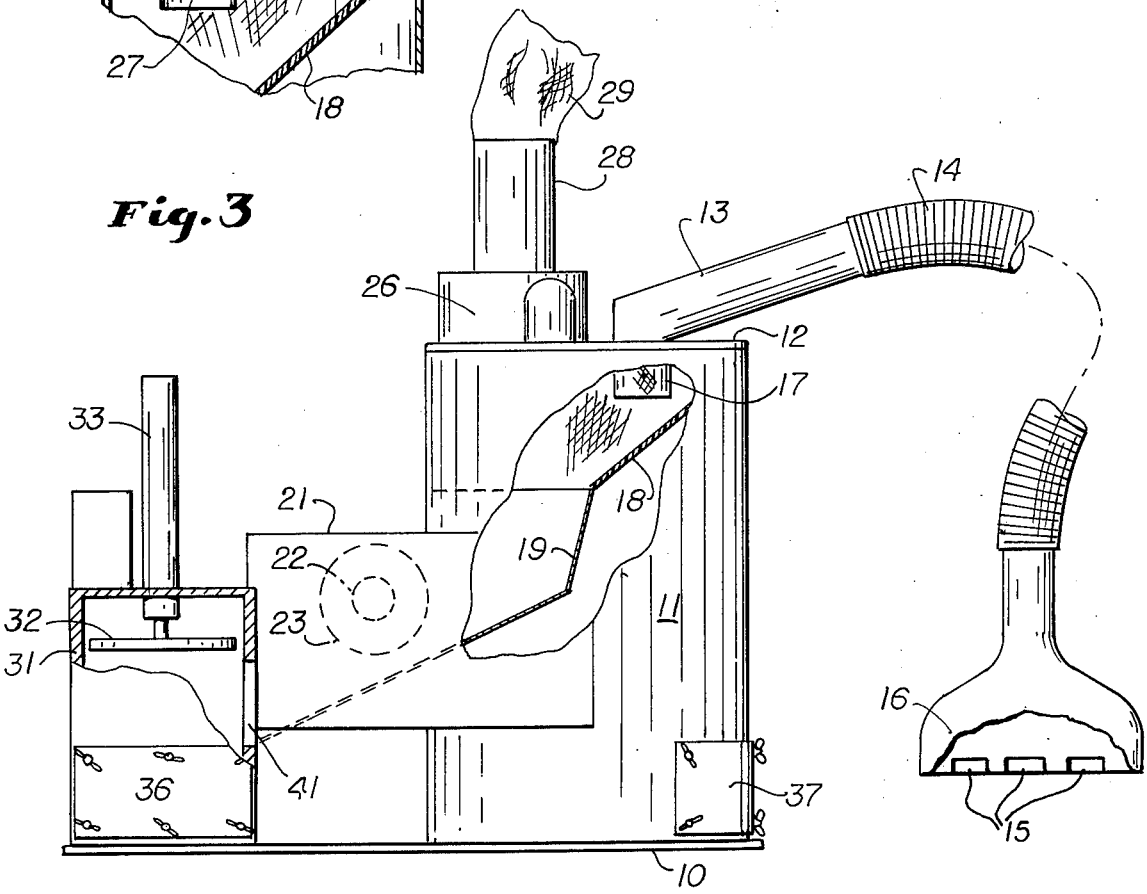
FIG. 1 is a side elevational view, partly broken away in section to reveal internal construction, of a machine in accordance with the present invention.

The shredded material discharged from shredder 21 is preferably compressed. As shown in FIGS. 1 and 2, mounted adjacent shredder 21 is a compactor housing 31, preferably verticaly disposed and having an intake opening 41 positioned to receive the discharge of shredder 21. Vertically reciprocable within cylinder 31 is a ram plate 32 which is driven by a vertically mounted hydraulic cylinder 33 on the top of the compactor. A power pack 34 consisting of a cylinder and a means for driving the hydraulic fluid is connected to the cylinder 33.

A clean-out opening 36 for the compactor and another cleanout opening 37 for the housing 11 are provided.

Where steel cans or glass containers are being handled, it is undesirable that they be shredded since the blades 23 will be damaged. Thus the shredder blades may be removed from the rotor 22 and the motor 24 not energized when such material is passing through the machine. Even pieces of wood such as small lengths of two-by-four may be shredded by the machine. It is desirable, of course, to segregate the different types of material prior to their entry into the machine so that the material removed is all of the same composition.

In use, therefore, selected material is drawn into duct 13 either using the hose 14, and optionally the nozzle 16 to pick up the debris from the ground such as parking lots, roadsides, etc.; or if the machine is stationarily mounted, the hose 14 may be eliminated and cans inserted manually into the duct 13. The fan 26 draws the material up through nozzle 16, hose 14 and duct 13, the draft of the fan being sufficient to lift this lightweight material. Within the housing 11 the very small dust particles and the like are drawn up through the fan 26 and discharged through duct 28; and, if in sufficient volume, collected in filter bag 29. The intermediate particles such as the lift tops of cans drop through the openings in the gratings 17 and 18 and fall to the bottom of the housing 11. They may be cleaned out periodically through the opening 37 and separately salvaged. Aluminum cans enter through duct 13, pass down through cylinder 17 and fall into the hopper 18 where they are conveyed downwardly into the chute 19 and pass under the shredder blades 23. The blades 23 shred the cans into considerably smaller size and they are discharged through opening 41 into the compactor housing 31. It is, of course, necessary that the ram plate 32 be elevated to upper position while the shredding operation is being conducted. When a considerable amount of debris has collected within the compactor housing 31, the fan 26 and shredder motor 24 are stopped. Thereupon, the power pack 34 causes the ram 33 to drive the plate 32 downwardly compressing the shredded cans in the bottom of the compactor housing 31. The compressed material may be removed from time to time through clean-out 36.

What is claimed is:

1. A machine for collecting metal cans and the like comprising a housing, a housing intake opening in said housing, a vacuum fan having its fan intake to draw air out of said housing and having its discharge remote from said housing, an elongated first screen within said housing below said housing intake, a housing discharge, a cylindrical second screen in said housing in registry with said housing intake to deflect cans away from said fan intake, a shredder positioned below and offset relative to said second screen, said shredder comprising a chute, a shaft, a plurality of saw blades on said shaft and a motor to drive said shaft, said housing discharge being in alignment with said chute, and a compactor to receive the discharge of said shredder, said compactor comprising a compactor housing having an opening receiving the discharge of said first-mentioned housing, a ram reciprocable in said compactor housing, and fluid actuated means to reciprocate said ram, said housing intake and said first screen being spaced from each other and remote from said housing discharge.

2. A machine according to claim 1 which further comprises an elongated flexible hose connected to said housing intake.

3. A machine according to claim 2 which further comprises a nozzle on the distal end of said hose having a magnet to remove iron from material passing into said hose.

4. A machine according to claim 1 which further comprises a sheet metal cylinder in said housing in registry with said fan intake, said cylinder being spaced from said first screen.

* * * * *